US008136581B2

(12) United States Patent
Tonosaki et al.

(10) Patent No.: US 8,136,581 B2
(45) Date of Patent: Mar. 20, 2012

(54) HEAT TRANSPORT APPARATUS AND HEAT TRANSPORT APPARATUS MANUFACTURING METHOD

(75) Inventors: Minehiro Tonosaki, Kanagawa (JP); Eisaku Kato, Tokyo (JP); Masakazu Yajima, Kanagawa (JP); Takashi Yajima, Tokyo (JP)

(73) Assignee: Sony Corporation, Tokyo (JP)

( * ) Notice: Subject to any disclaimer, the term of this patent is extended or adjusted under 35 U.S.C. 154(b) by 1087 days.

(21) Appl. No.: 10/538,296

(22) PCT Filed: Dec. 4, 2003

(86) PCT No.: PCT/JP03/15531

§ 371 (c)(1),
(2), (4) Date: Jun. 10, 2005

(87) PCT Pub. No.: WO2004/053412

PCT Pub. Date: Jun. 24, 2004

(65) Prior Publication Data

US 2006/0065385 A1 Mar. 30, 2006

(30) Foreign Application Priority Data

Dec. 12, 2002 (JP) ..... 2002-361525

(51) Int. Cl.
*F28D 15/00* (2006.01)
*H05K 7/20* (2006.01)

(52) U.S. Cl. ..... 165/104.26; 165/104.33; 165/135; 361/700; 29/890.032

(58) Field of Classification Search ..... 165/104.21, 165/104.26, 104.33, 135; 361/700; 29/890.032
See application file for complete search history.

(56) References Cited

U.S. PATENT DOCUMENTS 5,124,884 A * 6/1992 Yazu et al. ..... 165/185
5,562,949 A * 10/1996 Steele et al. ..... 427/397.7
5,583,317 A * 12/1996 Mennucci et al. ..... 165/185
5,697,428 A 12/1997 Akachi
(Continued)

FOREIGN PATENT DOCUMENTS

JP 64-54678 4/1989
(Continued)

OTHER PUBLICATIONS

U.S. Appl. No. 11/578,097, filed Oct. 10, 2006, Tonosaki, et al.
U.S. Appl. No. 12/765,694, filed Apr. 22, 2010, Tonosaki, et al.

*Primary Examiner* — Leonard R Leo
(74) *Attorney, Agent, or Firm* — Oblon, Spivak, McClelland, Maier & Neustadt, L.L.P.

(57) ABSTRACT

A heat transport device having a composite structure that is readily manufactured and a method for manufacturing such a heat transport device are provided. The heat transport device includes a first base plate having a liquid suction and retention unit for sucking and retaining a liquid-phase working fluid by capillary force; a second base plate having a face provided with a first concavity functioning as a vaporization chamber for vaporizing the working fluid, a second concavity functioning as a liquefaction chamber for liquefying the working fluid, a first ditch for transporting the vaporized working fluid, a second ditch for transporting the liquefied working fluid, the second base plate comprising a material having a thermal conductivity lower than that of silicon; and a thermoplastic or thermosetting resin material for bonding the first and second base plates. The heat transport device can be readily manufactured by heating the first and second base plates sandwiching a thermoplastic or thermosetting resin material therebetween.

6 Claims, 9 Drawing Sheets

U.S. PATENT DOCUMENTS

| | | | | |
|---|---|---|---|---|
| 5,943,543 | A * | 8/1999 | Uchida et al. | 419/2 |
| 6,418,019 | B1 * | 7/2002 | Snyder et al. | 361/700 |
| 6,437,981 | B1 * | 8/2002 | Newton et al. | 361/700 |
| 6,529,377 | B1 * | 3/2003 | Nelson et al. | 165/104.33 |
| 6,681,843 | B2 * | 1/2004 | Sugito | 165/135 |
| 6,698,502 | B1 * | 3/2004 | Lee | 165/135 |
| 6,860,322 | B1 * | 3/2005 | Rylewski | 165/135 |
| 6,976,527 | B2 * | 12/2005 | Kirshberg et al. | 165/104.33 |

FOREIGN PATENT DOCUMENTS

| | | |
|---|---|---|
| JP | 9-254899 | 9/1997 |
| JP | 3085205 | 7/2000 |
| JP | 3085205 | 1/2002 |
| JP | 2002-206882 | 7/2002 |

* cited by examiner

HEAT TRANSPORT APPARATUS AND HEAT TRANSPORT APPARATUS MANUFACTURING METHOD

TECHNICAL FIELD

The present invention relates to heat transport devices for transporting heat and relates to methods for manufacturing the heat transport devices.

BACKGROUND ART

Electronic apparatuses have been reduced in size and improved in performance. In general, such high-performance electronic apparatuses generate large amounts of heat and are required to dissipate internal heat of the electronic apparatuses in order to prevent unstable operation due to elevated temperature. However, the heat dissipation systems must be provided without increasing the sizes of the electronic apparatuses. For example, heat transport devices installed in desktop personal computers cannot be directly installed in CPUs of mobile devices.

In order to achieve a reduction in size and an improvement in performance of the electronic apparatuses described above, heatpipes are used for transporting heat from heat-generating sources to heat-dissipating units. Among them, capillary pumped loops/loop heat pipes (referred to CPL/LHP hereinafter) are now developed to achieve a high heat-transport capability and a reduction in size and thickness.

The basic principle of the CPL/LHP is almost the same as that of a general heatpipe; i.e. an enclosed refrigerant absorbs heat by vaporization in a vaporization unit and dissipates the heat by liquefaction in a liquefaction unit. Thus, the heat energy is transported from the vaporization unit to the liquefaction unit.

In the CPL/LHP, the liquefied refrigerant is sucked by capillary action (suction of the refrigerant by capillary force) and is transported to the vaporization unit so that the refrigerant is continuously vaporized, resulting in the continuous operation of the heatpipe.

A technology in which heatpipes are in a composite structure has been disclosed (see PCT Japanese Translation Patent Publication No. 2000-506432).

However, PCT Japanese Translation Patent Publication No. 2000-506432 does not sufficiently disclose a structure and a manufacturing process that are suitable for forming the heatpipe in a composite configuration. For example, a structure and a manufacturing process suitable for forming plastic CPL/LHP are not disclosed.

It is an object of the present invention to provide a heat transport device having a composite structure that is readily manufactured and a method for manufacturing such a heat transport device, in view of such a circumstance.

DISCLOSURE OF INVENTION

A heat transport device according to the present invention includes a first base plate having a liquid suction and retention unit for sucking and retaining a liquid-phase working fluid by capillary force; a second base plate facing the first base plate and comprising a material having a thermal conductivity lower than that of silicon; and a thermoplastic or thermosetting resin material for bonding the first and second base plates. The second base plate has a face provided with a first concavity functioning as a vaporization chamber for vaporizing the liquid-phase working fluid retained in the liquid suction and retention unit to a gas-phase working fluid, a second concavity functioning as a liquefaction chamber for liquefying the gas-phase working fluid vaporized at the vaporization chamber to the liquid-phase working fluid, a first ditch functioning as a channel for transporting the gas-phase working fluid from the vaporization chamber to the liquefaction chamber, and a second ditch functioning as a channel for transporting the liquid-phase working fluid from the liquefaction chamber to the liquid suction and retention unit.

The vaporization chamber and the liquefaction chamber are formed between the first and second base plates by heating the first and second base plates with the thermoplastic or thermosetting resin material disposed therebetween. Thus, the heat transport device can be readily manufactured.

The heat transport device may further include a third base plate facing the second base plate, so that the third base plate is disposed remote from the first base plate.

The third base plate can prevent the influx and efflux of gas when the second base plate comprises a material that allows atmospheric gas components or the gas-phase working fluid to penetrate.

More specifically, the second base plate is made of a resin material and the third base plate is made of a metal material.

Preferably, the difference in coefficient of linear expansion between the second base plate and the third base plate may be $5\times10^{-6}$ (1/° C.) or less. In such a case, the warp of the first and second base plates due to the difference in coefficient of linear expansion of the first and second base plates can be prevented, and the reliability of the heat transport device can be further improved.

The periphery of the first base plate and the periphery of the third base plate may be sealed so that the first base plate and the third base plate envelop the second base plate. The second base plate is further surely sealed by laminating the second base plate.

The heat transport device may further include a pair of laminating sheets disposed on the top face of the first base plate and on the bottom face of the second base plate so as to envelop the first and the second base plates. A metal foil such as an aluminum sheet is a preferable example of the laminating sheet. Thus, the first base plate and the second base plate can be further surely sealed.

The heat transport device may further include a fourth base plate facing the third base plate, so that the third base plate is disposed remote from the first base plate.

The fourth base plate can reinforce the heat transport device.

The heat transport device according to the present invention include a vaporization unit, a liquefaction unit, a channel for transporting a gas-phase working fluid from the vaporization unit to the liquefaction unit, and a channel for transporting a liquid-phase working fluid from the liquefaction unit to the vaporization unit. The vaporization unit includes a first base plate having a liquid suction and retention unit for sucking and retaining the liquid-phase working fluid by capillary force; a second base plate facing the first base plate, having a face provided with a concavity functioning as a vaporization chamber for vaporizing the liquid-phase working fluid retained in the liquid suction and retention unit to a gas-phase working fluid, and comprising a material having a thermal conductivity lower than that of silicon; and a thermoplastic or thermosetting resin material for bonding the first and second base plates. The liquefaction unit includes a third base plate at least partly having a plane; a fourth base plate facing the plane of the third base plate, having a face provided with a concavity functioning as a liquefaction chamber for liquefying the gas-phase working fluid vaporized at the vaporization unit to the liquid-phase working fluid, and comprising a material having a thermal conductivity lower than that of silicon; and a thermoplastic or thermosetting resin material for bonding the third and fourth base plates.

In this heat transport device, the vaporization unit can be readily formed by heating the first and second base plates with the thermoplastic or thermosetting resin material disposed therebetween, and the liquefaction unit can be readily formed by heating the third and the fourth base plates with the thermoplastic or thermosetting resin material disposed therebetween. The channels for connecting the vaporization unit and the liquefaction unit may comprise any material such as pipes.

A method for manufacturing the heat transport device according to the present invention includes a step of forming a first base plate having a liquid suction and retention unit for sucking and retaining a liquid-phase working fluid by capillary force; a step of forming a second base plate having a face provided with a first concavity functioning as a vaporization chamber for vaporizing the liquid-phase working fluid retained in the liquid suction and retention unit to a gas-phase working fluid, a second concavity functioning as a liquefaction chamber for liquefying the gas-phase working fluid vaporized at the vaporization chamber to the liquid-phase working fluid, a first ditch functioning as a channel for transporting the gas-phase working fluid from the vaporization chamber to the liquefaction chamber, and a second ditch functioning as a channel for transporting the liquid-phase working fluid from the liquefaction chamber to the liquid suction and retention unit; a step of laminating the first base plate, a thermoplastic or thermosetting resin material, and the second base plate; and a step of bonding the first and the second base plates with the thermoplastic or thermosetting resin material by heating the laminated first base plate, the thermoplastic or thermosetting resin material, and the second base plate under a pressurized condition.

The vaporization chamber and the liquefaction chamber are formed between the first and second base plates by heating the first and second base plates with the thermoplastic or thermosetting resin material disposed therebetween. Thus, the heat transport device can be readily manufactured.

BEST MODE FOR CARRYING OUT THE INVENTION

Embodiments of the present invention will now be described with reference to drawings.

First Embodiment

Figure 1:
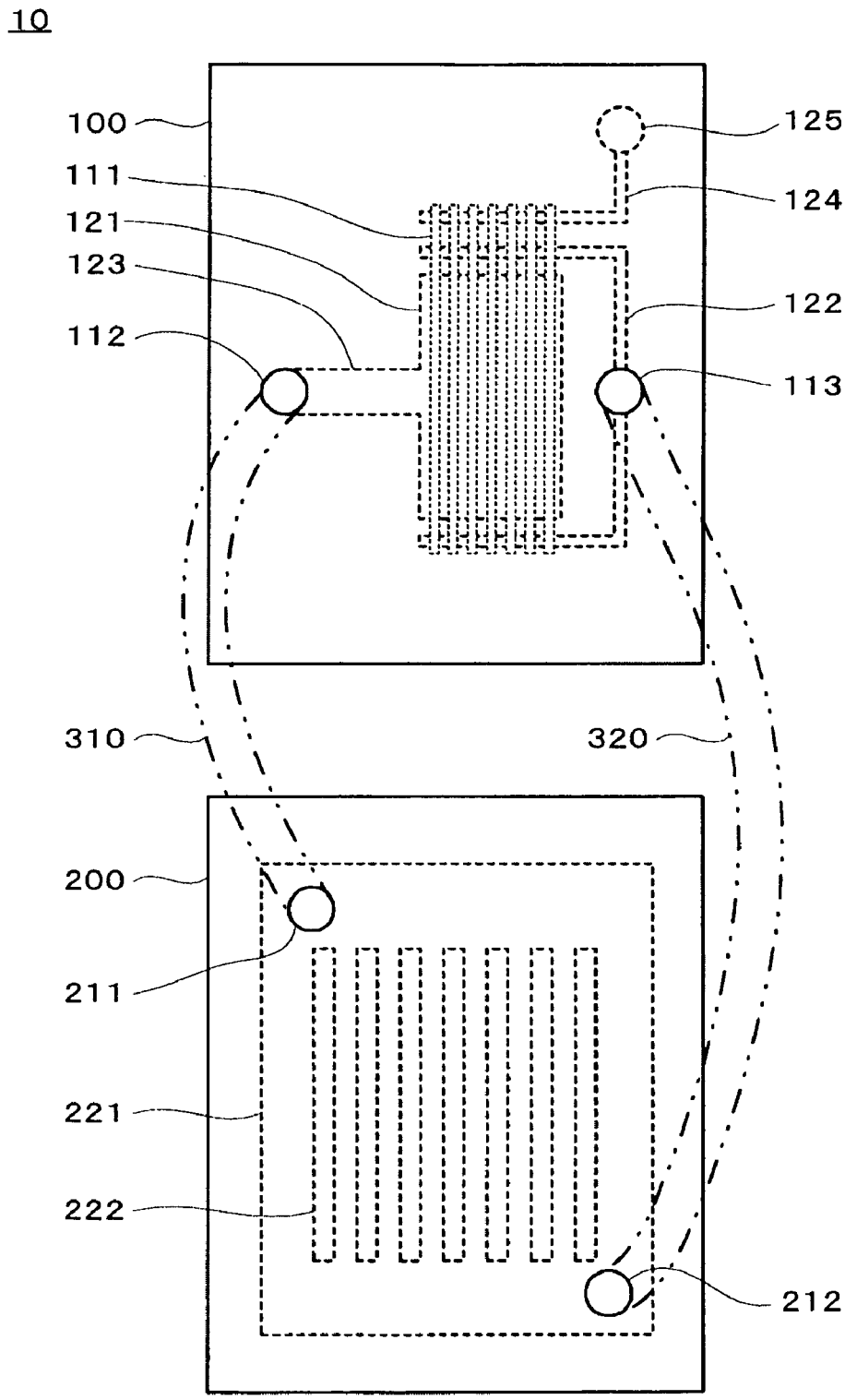
FIG. 1 is a front view of a heat transport device 10 according to a first embodiment of the present invention.
Figure 2:
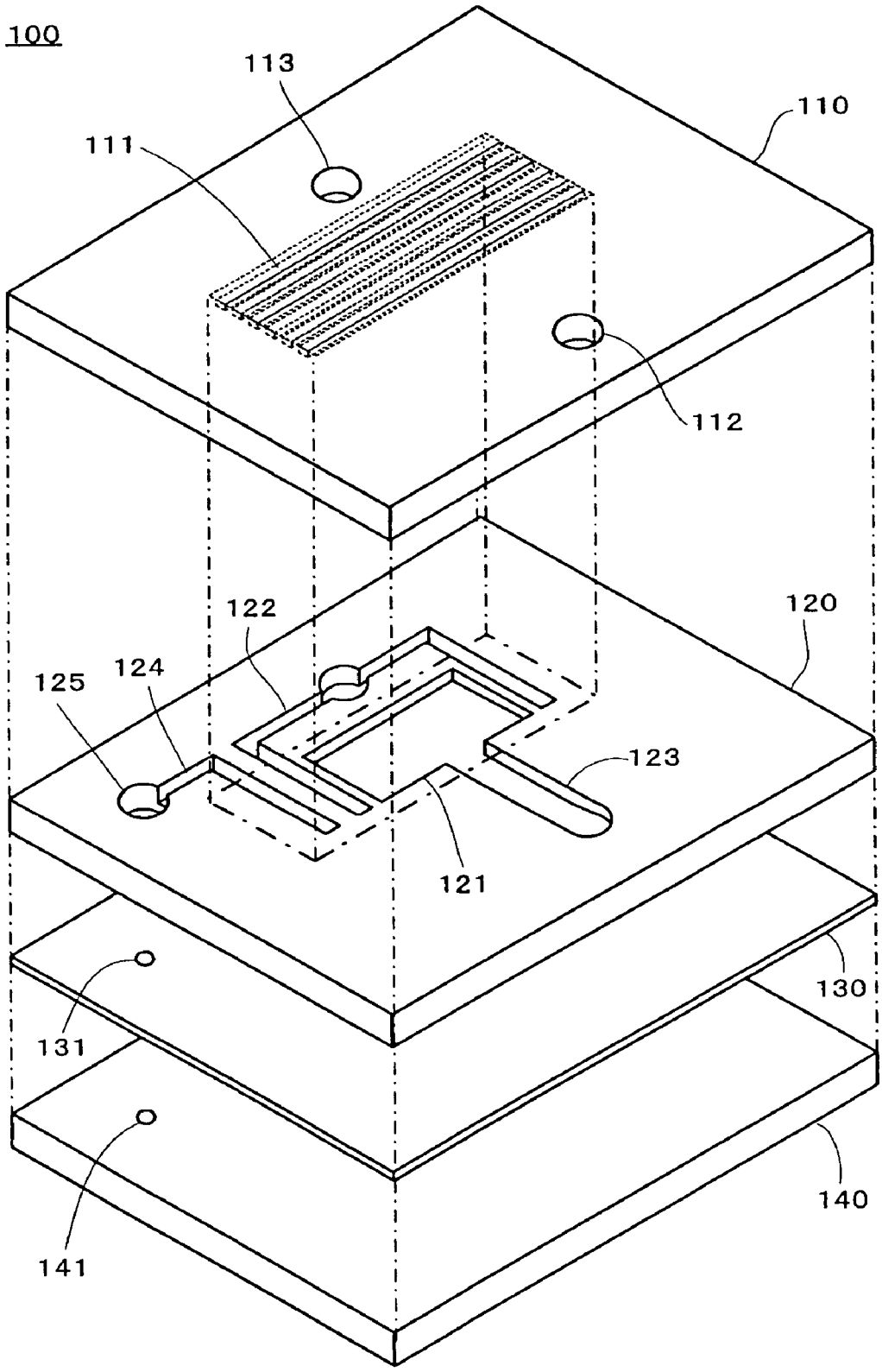
FIG. 2 is an exploded perspective view showing a vaporization unit for the heat transport device according to the first embodiment.
Figure 3:
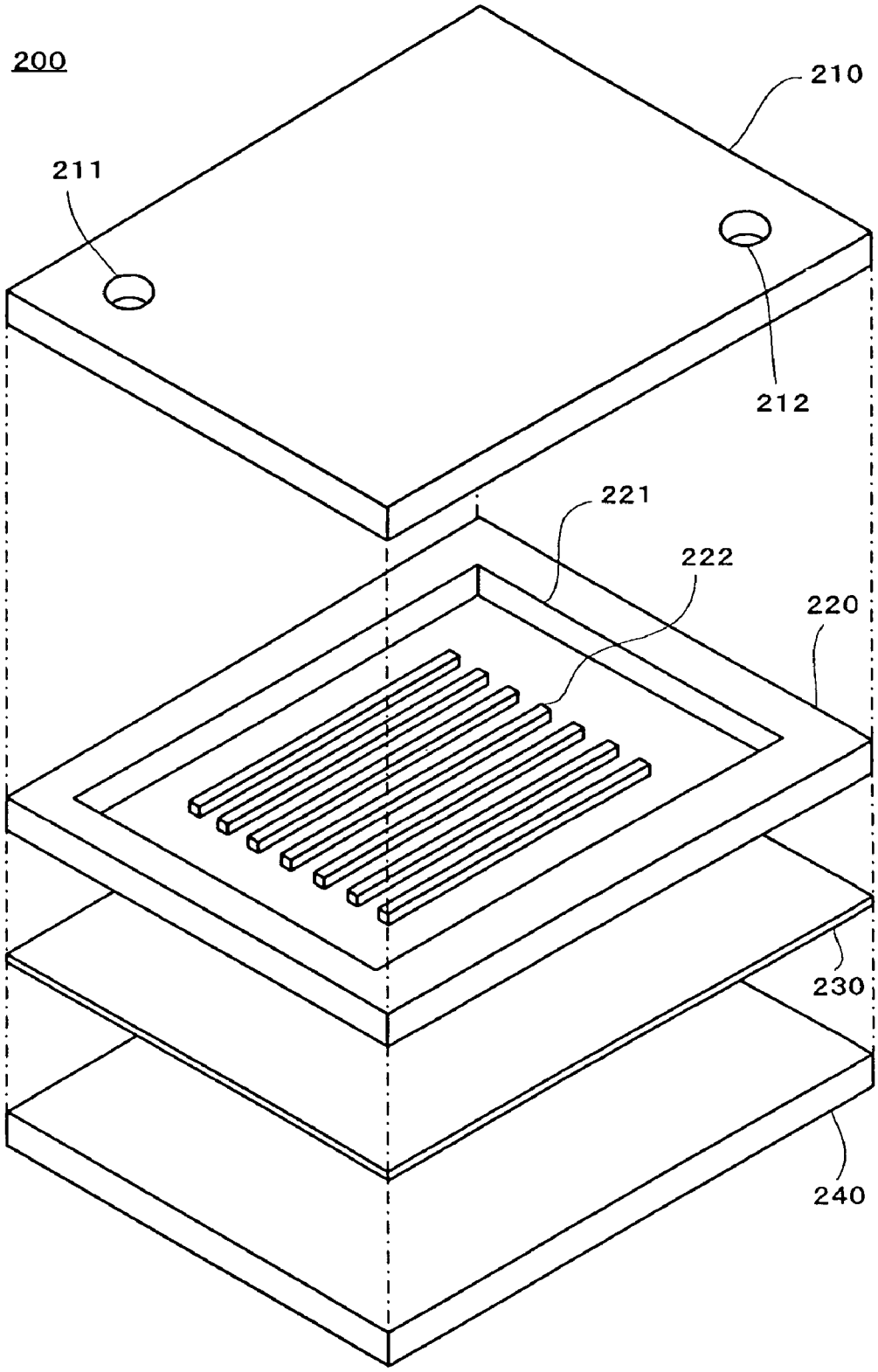
FIG. 3 is an exploded perspective view showing a liquefaction unit for the heat transport device according to the first embodiment.

FIG. 1 is an exploded perspective view showing a heat transport device 10 according to a first embodiment of the present invention. FIGS. 2 and 3 are exploded perspective views showing a vaporization unit 100 and a liquefaction unit 200, respectively, of the heat transport device.

With reference to FIGS. 1 to 3, the heat transport device 10 includes a vaporization unit (or referred to as an evaporator unit or evaporator) 100 composed of four base plates 110, 120, 130, and 140; a liquefaction unit (or referred to as a condenser unit or condenser) 200 composed of four base plates 210, 220, 230, and 240; and pipes 310 and 320 for connecting the vaporization unit 100 and the liquefaction unit 200. The heat transport device 10 contains working fluid or a refrigerant (not shown in FIGS. 1 to 3).

The pipes 310 and 320 may comprise any material (e.g. a metal or resin material).

The working fluid functions as a refrigerant. Water is used in this embodiment; however, ammonia, ethanol, Fluorinert, or the like may be used if necessary.

The working fluid is vaporized in the vaporization unit 100 into a gas-phase working fluid and moves to the liquefaction unit 200 through the pipe 310. The gas-phase working fluid is liquefied in the liquefaction unit 200 into a liquid-phase working fluid. The liquid-phase working fluid moves to the vaporization unit 100 through the pipe 320 and is revaporized. Thus, the working fluid circulates in the vaporization unit 100, the pipe 310, the liquefaction unit 200, and the pipe 320, and transports heat from the vaporization unit 100 to the liquefaction unit 200 as latent heat. In such a manner, the heat transport device 10 can cool components disposed near the vaporization unit 100.

The vaporization unit includes the four base plates 110, 120, 130, and 140.

The base plate 110 is formed of a material having a high thermal conductivity and has grooves 111 and through-holes 112 and 113.

The grooves 111 suck the liquid-phase working fluid by capillary action and retain it; i.e. they function as a liquid suction and retention unit (so-called wick) for sucking and retaining the fluid. The liquid-phase working fluid retained in the grooves 111 is vaporized (evaporated) into a gas-phase working fluid. The grooves 111 have, for example, a width of 50 μm and a depth of several tens of micrometers to 100 μm.

The through-hole 112 is connected with the pipe 310 to discharge the gas-phase working fluid to the pipe 310. The through-hole 113 is connected with the pipe 320 to charge the liquid-phase working fluid from the pipe 320.

An anti-corrosion treatment may be applied to regions of the base plate 110 exposed to the working fluid, if necessary.

For example, when the base plate 110 is made of copper and the working fluid is water, an overcoat is formed in order to inhibit the corrosion of copper by water.

The base plate 120 has a concavity 121, ditches 122 to 124, and a through-hole 125.

The concavity 121, together with the bottom face of the base plate 110, functions as a vaporization chamber for vaporizing the liquid-phase working fluid retained in the grooves 111.

The ditch 122, together with the bottom face of the base plate 110, functions as a channel for transporting the liquid-phase working fluid charged from the through-hole 113 to the grooves 111. The liquid-phase working fluid charged from the through-hole 113 to the ditch 122 flows toward both ends of each of the grooves 111. The working fluid is sucked by capillary action at these ends of the grooves 111.

The ditch 123, together with the bottom face of the base plate 110, connects the concavity 121 to the through-hole 112 and functions as a channel for transporting the working fluid vaporized in the concavity 121 to the through-hole 112. The ditch 124, together with the bottom face of the base plate 110, functions as a channel for transporting the liquid-phase working fluid charged from the through-hole 125 to the grooves 111.

The through-hole 125 is an opening for supplying a working fluid.

The width of the ditches 122 and 124 is, for example, 100 μm, and the width of the ditch 123 should be wider than that for the following reasons: The ditches 122 and 124 function as a passage for liquid to charge the liquid-phase working fluid by capillary action and the ditch 123 functions as a passage for gas to discharge the liquid-phase working fluid by differential pressure only.

The base plate 130 further ensures an airtight seal of the vaporization unit 100. Some materials for the base plate 120 may allow atmospheric gas components or the gas-phase working fluid to penetrate. For example, when the base plate 120 is made of a plastic (resin) material, the influx of atmospheric gas components into the vaporization unit 100 or the efflux of the gas-phase working fluid may occur because the plastic material allows atmospheric gas components and water vapor to penetrate. Since a metal can block the influx and efflux of gas, the use of the base plate 130 made of a metal prevents the influx and efflux of gas into and from the vaporization unit 100. The metal-made base plate 130 can also reinforce the rigidity of the plastic base plate 120. The base plate 130 is provided with a through-hole 131 at a position corresponding to the through-hole 125 to supply a working fluid.

The base plate 140 is provided for reinforcement, and is not directly involved in the function of the vaporization unit 100. The base plate 140 is provided with a through-hole 141 at a position corresponding to the through-hole 131 to supply a working fluid. The through-hole 141 is closed when the working fluid is not supplied.

The liquefaction unit 200 includes the four base plates 210, 220, 230, and 240.

The base plate 210 is formed of a material having a high thermal conductivity and has through-holes 211 and 212. The through-hole 211 is connected with the pipe 310 to charge the gas-phase working fluid from the pipe 310. The through-hole 212 is connected with the pipe 320 to discharge the liquid-phase working fluid to the pipe 320.

An anti-corrosion treatment may be applied to regions of the base plate 210 exposed to the working fluid, if necessary. For example, when the base plate 210 is made of copper and the working fluid is water, an overcoat is formed in order to inhibit the corrosion of copper by water.

The base plate 220 has a concavity 221 and protrusions 222.

The concavity 221, together with the bottom face of the base plate 210, functions as a liquefaction chamber for liquefying the gas-phase working fluid charged from the pipe 310.

The protrusions 222 are disposed in the concavity 221 and function as fins of a condenser for liquefying the gas-phase working fluid charged from the through-hole 211 to a liquid-phase working fluid. An example of the protrusions 222 is a rectangular column having a rectangular bottom face with a width of 1 mm.

The base plate 230 further ensures an airtight seal of the liquefaction unit 200. Some materials for the base plate 220 may allow atmospheric gas components or the gas-phase working fluid to penetrate. For example, when the base plate 220 is made of a plastic (resin) material, the influx of atmospheric gas components into the liquefaction unit 200 or the efflux of the gas-phase working fluid may occur because the plastic material allows atmospheric gas components and water vapor to penetrate. Since a metal can block the influx and efflux of gas, the use of the base plate 230 made of a metal prevents the influx and efflux of gas into and from the vaporization unit 200.

The base plate 240 is provided for reinforcement, and is not directly involved in the function of the liquefaction unit 200.

The above-mentioned base plates 110, 120, 130, 140, 210, 220, 230, and 240 can be made of a combination of various materials.

Preferably, the base plates 110 and 210 are made of a metal having a high thermal conductivity, for example, copper, aluminum, or stainless steel (e.g. SUS304) so that heat is readily transferred into the vaporization unit 100 and readily dissipated from the liquefaction unit 200. Among them, copper is the most preferable material due to its high thermal conductivity. The base plate 110 must have a predetermined thickness required for forming the grooves 111. A sheet having a thickness of 0.05 to 1 mm, for example, a thickness of 0.3 mm, can be used for the base plate 110. Although the base plate 210 does not have any limitation in the thickness, a sheet having a thickness of 0.05 to 1 mm, for example, a thickness of 0.3 mm, can be used for the base plate 210.

The base plates 120 and 220 can be made of a plastic (resin) material (e.g. thermoplastic or non-thermoplastic polyimide material and olefin material), glass, or metal (e.g. copper, aluminum, and stainless steel such as SUS304).

The base plates 120 and 220 must have a predetermined thickness required for forming the concavities 121 and 221. A sheet having a thickness of 0.1 to 1 mm, for example, a thickness of 0.5 mm, can be used for the base plates 120 and 220.

Preferably, the base plates 120 and 220 have a similar coefficient of thermal expansion to that of the base plates 110 and 210, respectively. If the difference in coefficient of thermal expansion between the base plate 110 and the base plate 120 (or the base plate 210 and the base plate 220) is large, the base plates 110 and 120 (or the base plates 210 and 220) warp with a change in temperature due to heating and cooling (so-called bimetallic effect). This may cause leakage of the working fluid from a gap between the base plate 110 and the base plate 120 (or the base plate 210 and the base plate 220).

The warp can be reduced by decreasing the difference in coefficient of linear expansion between the base plates 110 and 120 to, for example, $5\times10^{-6}$ (1/° C.) or less. Therefore, when the base plate 110 is made of copper (coefficient of linear expansion: $16.5\times10^{-6}$ (1/° C.)], Kapton (trade name of Toyo Rayon Co., Ltd.) may be used for the base plate 120 made of plastic, optical glass FPL45 (trade name of Ohara Inc.) for the base plate 120 made of glass, or copper for the base plate 120 made of metal.

The base plates 130 and 230 can be made of a metal material, for example, copper, aluminum, or stainless steel (e.g. SUS304). The base plates 130 and 230 prevent influx and efflux of gas through the plastic base plates 120 and 220, respectively. Therefore, a sheet (foil) having a thickness of about 0.05 mm, which is sufficient for preventing the migration of gas, can be used for the base plates 130 and 230. Furthermore, when the base plates 120 and 220 are made of metal or glass, the base plates 130 and 230 are unnecessary.

From the viewpoint of thermal expansion, it is preferable that the difference in coefficient of linear expansion between the base plate 130 (or the base plate 230) and the base plate 110 (or the base plate 210) be not large. However, since the force due to the thermal expansion of the thin base plate 130 (or 230) is small, the coefficient of linear expansion of the base plate 130 (or 230) is not necessarily identical to that of the base plates 110 (or 210).

The base plates 140 and 240 are provided for reinforcement and can be made of any material. A material that is light in weight and has a certain strength is preferable for reducing the weight of the heat transport device 10. For example, a plastic material such as polyimide is preferable. Regarding the base plates 140 and 240, for example, a sheet having a thickness of about 0.5 mm is preferably used.

These base plates 110, 120, 130, and 140 and the base plates 210, 220, 230, and 240 can be bonded with a resin-containing bonding material BM (in a form of liquid or film; e.g. a thermoplastic film, a thermosetting film, or a thermosetting adhesive). Specifically, a thermosetting olefin-resin film, a hot-melt polyimide film (e.g. Upilex VT: trade name of Ube Industries, Ltd.), a thermosetting adhesive film (e.g. Adhesive Sheet 1592 (a thermoplastic adhesive containing a minor thermosetting component): trade name of Sumitomo 3M, Ltd.), a thermosetting epoxy adhesive (e.g. Aron Mighty BX-60: trade name of Toagosei Co., Ltd.), and a modified epoxy adhesive (e.g. Aron Mighty AS-60, AS-210BF: trade name of Toagosei Co., Ltd.) can be used. Preferably, the thickness of the bonding material BM is between about 0.15 and about 0.5 mm.

When the difference in thermal expansion between the base plates 110 and 120 (or the base plates 210 and 220) is higher than a certain value, it is preferable that the bonding material BM used for bonding the base plates 110 and 120 (or the base plates 210 and 220) have a predetermined flexibility to absorb the difference in thermal expansion between the base plates. Namely, an adhesive having a low Young's modulus is preferable. For example, an olefin-resin film can be used.

The heat transport device 10 has the following advantages:

The heat transport device 10 can be fabricated by bonding the base plates 110, 120, 130, and 140 and the base plates 210, 220, 230, and 240 with the bonding material BM, and is lightweight, thin, and highly shock-resistant.

In the heat transport device 10, the base plates 130 and 230 can prevent the influx and efflux of gas into and from the device, resulting in an improvement in reliability of the heat transport device 10. These base plates 130 and 230 may be made of, for example, a metal foil functioning as a barrier film.

(Manufacturing Process of the Heat Transport Device 10)

Figure 4:
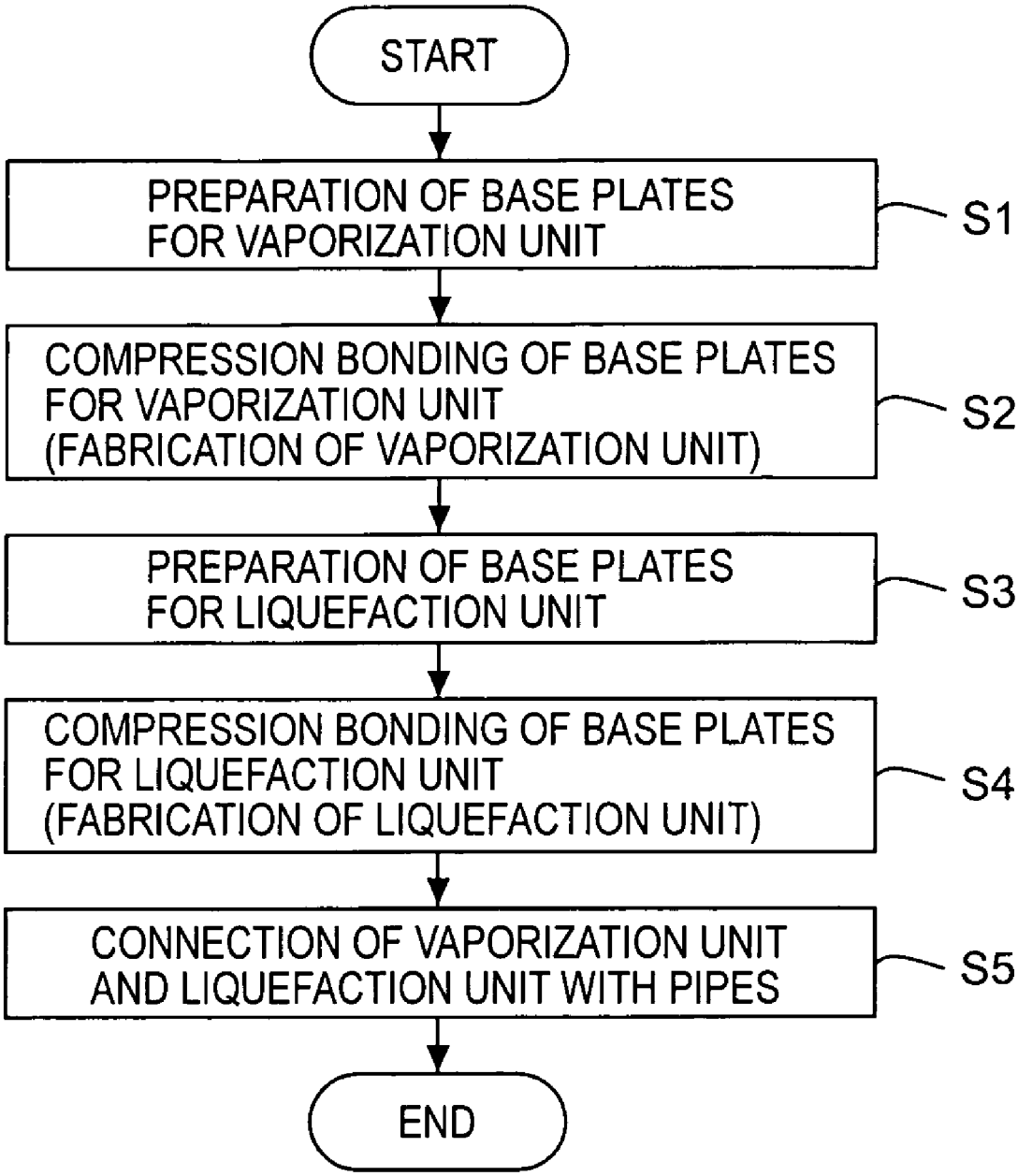
FIG. 4 is a flow chart showing an example of a manufacturing process of the heat transport device according to the first embodiment.
Figure 5A:
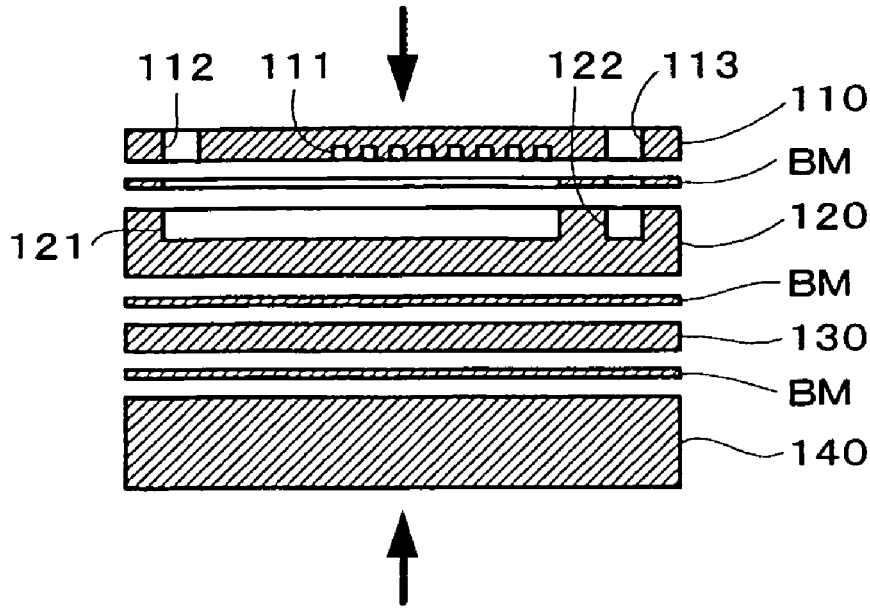
FIG. 5A is a cross-sectional view showing the state of the vaporization unit during the manufacturing process of the heat transport device according to the first embodiment.
Figure 5B:
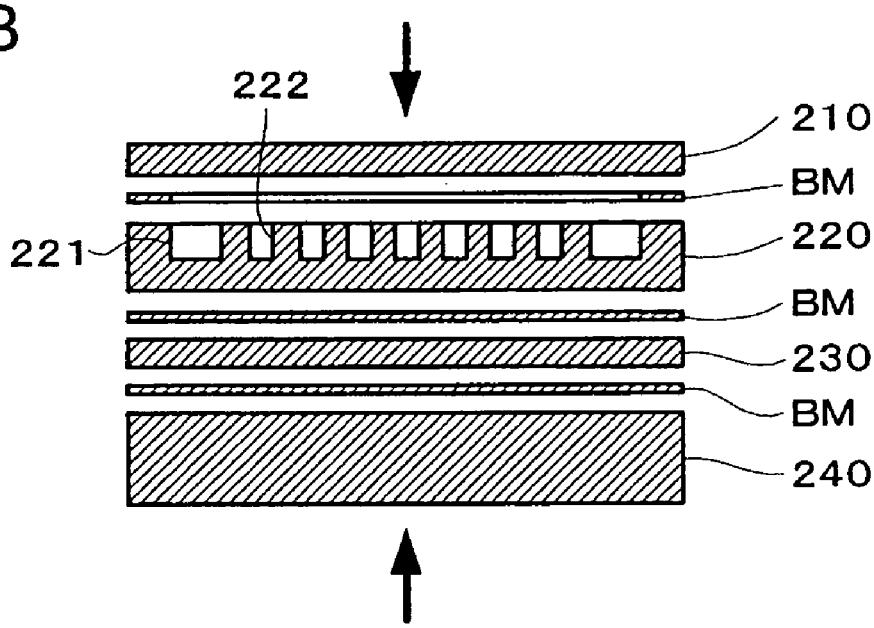
FIG. 5B is a cross-sectional view showing the state of the liquefaction unit during the manufacturing process of the heat transport device according to the first embodiment.

FIG. 4 is a flow chart showing a manufacturing process of the heat transport device 10. FIGS. 5A and 5B are cross-sectional views of the vaporization unit 100 and the liquefaction unit 200, respectively, during the manufacturing process.

The heat transport device 10 is fabricated by connecting the vaporization unit 100 and the liquefaction unit 200 with the pipes 310 and 320. The vaporization unit 100 and the liquefaction unit 200 are independently fabricated. The order of the fabrication of them is not limited.

(1) Preparation of the Vaporization Unit 100 (Steps S1 and S2)

The base plates 110, 120, 130, and 140 are prepared and then fabricated to the vaporization unit 100 by thermocompression bonding or the like.

(a) The base plate 110 is prepared by forming grooves 111 and through-holes 112 and 113 on a metal (e.g. copper) sheet.

The through-holes 112 and 113 can be formed by punching, etching, or the like.

The grooves 111 can be formed by etching using a photoresist mask (formation by photoetching) or by electroforming on a mold with copper and separating the mold (formation with electroforming mold). For example, grooves 111 having a width of 50 μm and a depth of 40 μm are formed by photoetching, and grooves 111 having a width of 50 μm and a depth of 100 μm are formed with the electroforming mold.

If the base plate 110 is corrosive to the working fluid (e.g. the base plate 110 is made of copper and the working fluid is water), the surface of the base plate 110 is covered with a protective film to prevent direct contact of the working fluid with the surface. For example, an oxidized surface of copper is coated with a thin film of silicon or titanium, and then is oxidized by plasma treatment. In this case, copper is protected by an oxide double-layer such as copper oxide and silicon dioxide (or titanium dioxide) from water.

The base plate 120 can be prepared by forming the concavity 121, the ditches 122 to 124, and the through-hole 125 on a plastic material (e.g. a non-thermoplastic or thermoplastic polyimide sheet).

The through-hole 125 can be formed by, for example, punching. The concavity 121 and the ditches 122 to 124 can be formed by irradiating the plastic sheet with a focused UV YAG laser beam. When the base plate 120 is made of glass or metal, etching can be used.

The base plates 130 and 140 may be prepared, for example, by forming through holes in a plastic or metal material by punching, etching, or the like.

(b) A bonding material BM is arranged between the respective base plates 110, 120, 130, and 140 prepared above, and the resulting composite is heated under a pressurized condition so that the base plates 110, 120, 130, and 140 are bonded by thermal curing of the thermosetting bonding material BM or by melting of the thermoplastic bonding material BM (FIG. 5A). When a bonding material BM is a film, the regions not used for the bonding are preferably removed by punching before the bonding process so as to avoid unnecessary adhesion. When the bonding material BM is a liquid, it may be applied to bonding regions only.

(2) Preparation of the Liquefaction Unit 200 (Steps S3 and S4)

The base plates 210, 220, 230, and 240 are prepared and then fabricated to the liquefaction unit 200 by thermocompression bonding or the like.

(a) The base plate 210 is prepared by forming the through-holes 211 and 212 in a metal (e.g. copper) sheet by punching or the like.

The base plate 220 can be prepared by forming the concavity 221 and the protrusions 222 on a plastic material (e.g. non-thermoplastic or thermoplastic polyimide sheet). The concavity 221 and the protrusions 222 can be formed by irradiating the plastic sheet with a focused UV YAG laser beam. When the base plate 220 is made of glass or metal, etching can be used. Thus, for example, the rectangular columnar protrusions 222 having a width of 1 mm are formed in the concavity.

(b) A bonding material BM is arranged between the respective base plates 210, 220, 230, and 240 prepared above, and the resulting composite is heated under a pressurized condition so that the base plates 210, 220, 230, and 240 are bonded (FIG. 5B).

(3) Connection of the Vaporization Unit 100 and the Liquefaction Unit 200 with Pipes (step S5)

The vaporization unit 100 and the liquefaction unit 200 are connected with the pipes 310 and 320, for example, with a liquid adhesive.

(Exemplary Structures)

Examples of a combination of the base plates 110, 120, 130, and 140 and the bonding material BM will now be described. The same relationship can be applied to a combination of the base plates 210, 220, 230, and 240 and the bonding material BM.

(1) Structure 1 [base plate 110: copper sheet, base plate 120: non-thermoplastic polyimide sheet (e.g. Kapton: trade name of Toyo Rayon Co., Ltd.) or olefin-resin sheet, base plate 130: copper sheet, base plate 140: non-thermoplastic polyimide sheet or olefin-resin sheet, and bonding material BM: thermosetting adhesive film (e.g. Adhesive Sheet 1592: trade name of Sumitomo 3M, Ltd.)]

For example, the bonding material BM is arranged between the respective base plates 110, 120, 130, and 140, and then the resulting composite is bonded at a pressure of 2 $Kg/cm^2$ for 1 minute with a press to fabricate the vaporization unit 100.

(2) Structure 2 [base plate 110: copper sheet, base plate 120: glass sheet (e.g. optical glass FPL45 (trade name of Ohara Inc.) is preferable in view of the coefficient of linear expansion in the copper sheet), base plate 130: copper sheet, base plate 140: glass sheet, and bonding material BM: thermosetting adhesive film (e.g. Adhesive Sheet 1592: trade name of Sumitomo 3M, Ltd.) or thermoplastic adhesive film (Upilex VT: trade name of Ube Industries, Ltd.)]

For example, the bonding material BM is arranged between the respective base plates 110, 120, 130, and 140, and then the resulting composite is bonded at a pressure of 2 $Kg/cm^2$ for 1 minute with a press to fabricate the vaporization unit 100.

(3) Structure 3 (base plate 110: copper sheet, base plate 120: thermoplastic polyimide sheet, base plate 130: copper sheet, base plate 140: thermoplastic polyimide sheet, and bonding material BM: thermoplastic polyimide film)

For example, the bonding material BM is arranged between the respective base plates 110, 120, 130, and 140, and then the resulting composite is bonded at a pressure of 40 $Kg/cm^2$ for 10 minutes under a reduced pressure of $10^{-3}$ Pa with a vacuum press to fabricate the vaporization unit 100.

(4) Structure 4 (base plate 110: copper sheet, base plate 120: copper sheet, base plate 130: not used, base plate 140: thermoplastic polyimide sheet, and bonding material BM: thermoplastic polyimide film)

For example, the bonding material BM is arranged between the respective base plates 110, 120, and 140, and then the resulting composite is bonded at a pressure of 40 $Kg/cm^2$ for 10 minutes under a reduced pressure of $10^{-3}$ Pa with a vacuum press to fabricate the vaporization unit 100.

(5) Structure 5 (the aluminum-foil base plate 130 is used in the vaporization unit 100 having any one of structures 1 to 4)

The aluminum sheet instead of the copper sheet can prevent the penetration of gas.

Second Embodiment

Figure 6:
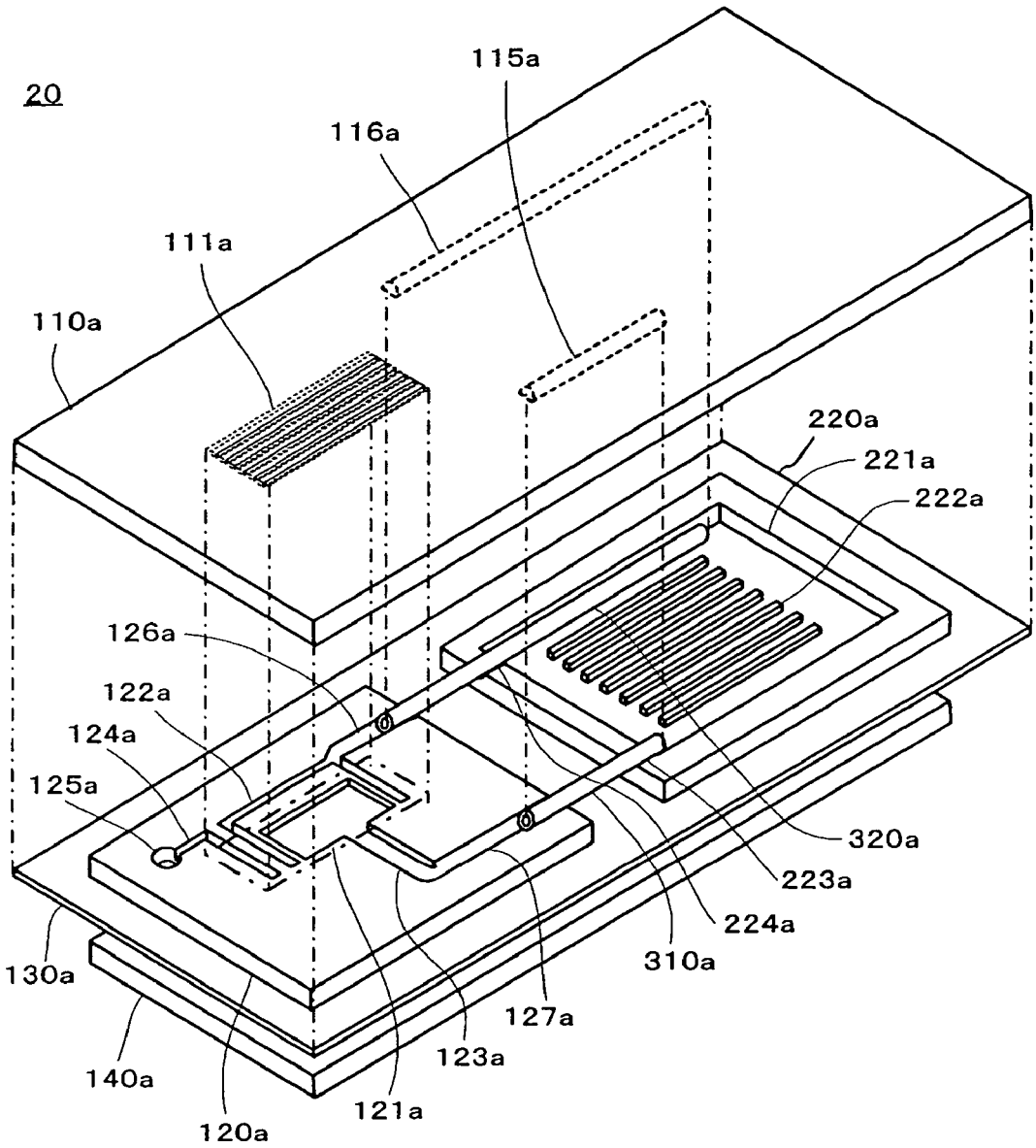
FIG. 6 is an exploded perspective view of a heat transport device according to a second embodiment of the present invention.

FIG. 6 is an exploded perspective view of a heat transport device according to a second embodiment of the present invention. The heat transport device 20 includes base plates 110*a*, 120*a*, 220*a*, 130*a*, and 140*a* and pipes 310*a* and 320*a*. The base plates 120*a* and 220*a* are enveloped by the base plates 110*a* and 130*a* after assembling.

The heat transport device 20 has monolithic base plates each corresponding to the base plates 110 and 210, the base plates 130 and 230, and the base plates 140 and 240 of the heat transport device 10 according to the first embodiment.

The monolithic base plate 110*a* corresponds to the base plates 110 and 210 in the first embodiment, and is made of a material having a high thermal conductivity. The base plate 110*a* includes grooves 111*a* and concavities 115*a* and 116*a*, and may be made of a combination of a plurality of materials. The efficiency of the heat transport device 20 can be further improved by disposing a material having a high thermal insulation between the vaporization unit and the liquefaction unit.

The grooves 111*a* function as a liquid suction and retention unit (so-called wick) for sucking the liquid-phase working fluid by capillary action and retaining the fluid.

The concavities 115*a* and 116*a* have shapes corresponding to the upper portions of the pipes 310*a* and 320*a*, and can receive the pipes 310*a* and 320*a*, respectively. The base plate 110*a* can be made of a material used for the base plate 110, and may be also prevented from corrosion by the working fluid if necessary as in the base plate 110.

The base plate 120*a* corresponds to the base plate 120 in the first embodiment, and includes a concavity 121*a*, ditches 122*a* to 124*a*, and a through-hole 125*a* corresponding to the concavity 121, the ditches 122 to 124, and the through-hole 125, respectively. The ditches 122*a* and 123*a* include concavities for receiving ends of the pipes 320*a* and 310*a*, respectively.

Since the base plate 120*a* is substantially the same as the base plate 120 except for the above, the detailed description is omitted.

The base plate 220*a* corresponds to the base plate 220 in the first embodiment, and includes a concavity 221*a* and protrusions 222*a* corresponding to the concavity 221 and the protrusions 222, respectively. Concavities 223*a* and 224*a* having shapes corresponding to the lower portions of the pipes 310*a* and 320*a*, respectively, are provided adjacent to the concavity 221*a*, and receive the pipes 310*a* and 320*a*, respectively.

Since the base plate 220*a* is substantially the same as the base plate 220 except for the above, the detailed description is omitted.

The monolithic base plate 130*a* corresponds to the base plates 130 and 230 in the first embodiment, and includes a through-hole 131*a* (not shown) at a position corresponding to the through-hole 125*a*. Since the base plate 130*a* is substantially the same as the base plate 130 except for the above, the detailed description is omitted.

The monolithic base plate 140*a* corresponds to the base plates 140 and 240 in the first embodiment, and includes a through-hole 141*a* (not shown) at a position corresponding to the through-hole 131*a*. Since the base plate 140*a* is substantially the same as the base plate 140 except for the above, the detailed description is omitted.

In the heat transport device 20 according to this embodiment, though the base plates 120*a* and 220*a* correspond to the vaporization unit and the liquefaction unit, respectively, the base plates 110*a* and 130*a* are shared by the vaporization unit and the liquefaction unit. Therefore, the structure of the heat transport device 20 is simplified and the vaporization unit and the liquefaction unit can be readily formed at the same time.

(Manufacturing Process of the Heat Transport Device 20)

The base plates 110*a*, 120*a*, 220*a*, and 130*a* are prepared and then stacked so as to sandwich the pipes 310*a* and 320*a*. The resulting composite is bonded to complete the heat transport device 20.

(1) The base plates 110*a*, 120*a*, 220*a*, and 130*a* can be prepared by the same process as that in the first embodiment.

Figure 7A:
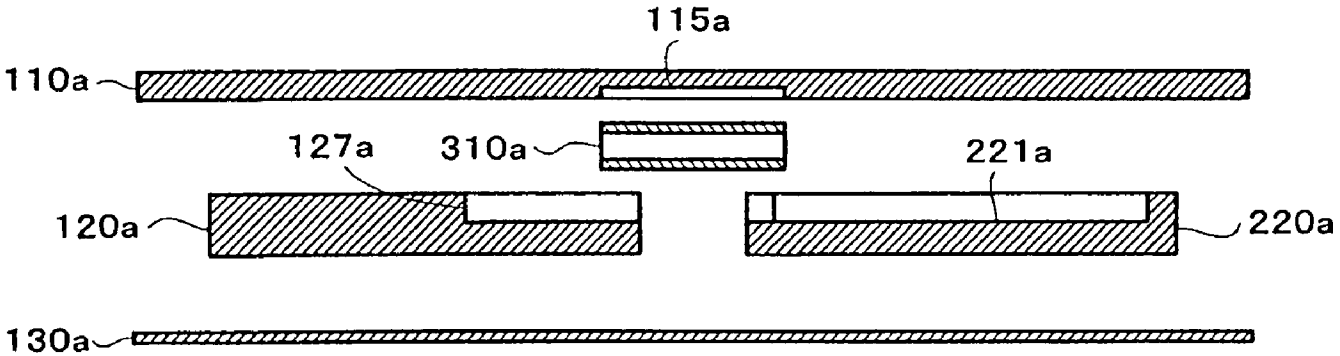
FIGS. 7A to 7C are cross-sectional views showing a manufacturing process of the heat transport device according to the second embodiment of the present invention.

(2) The prepared base plates 110*a*, 120*a*, 220*a*, and 130*a* are stacked (see FIG. 7A). The pipes 310*a* and 310*b* are disposed between the base plate 110*a* and the base plates 120*a* and 220*a*. A bonding material BM (not shown) is arranged between the respective base plates 110*a*, 120*a*, 220*a*, and 130*a*.

Figure 7B:
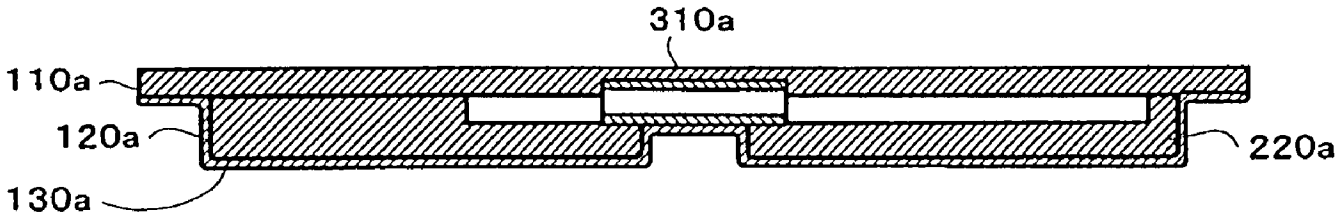

(3) The composite of the base plates 110*a*, 120*a*, 220*a*, and 130*a* is pressed from the top and the bottom, and heated so as to be bonded (see FIG. 7B). Then, the base plate 130*a* adheres to the peripheries of the base plates 120*a* and 220*a* and the pipes 310*a* and 320*a*, and the heat transport device 20 is sealed.

The base plates 120*a* and 220*a* can be tightly sealed by laminating the periphery of the base plate 11*a* and the periphery of the base plate 130*a* (e.g. a metal foil such as an aluminum sheet) so as to envelop the base plates 120*a* and 220*a*. The lamination may be performed after or during the adhesion of the base plates 110*a*, 120*a*, 220*a*, and 130*a*. The lamination may be performed using an additional sheet (not shown). In such a case, this sheet and the base plate 130*a* together envelop the base plates 110*a* and base plates 120*a* and 220*a*. For example, the use of a metal foil such as an aluminum sheet for this sheet and the base plate 130*a* further improves the sealing of the base plates 110*a* and base plates 120*a* and 220*a*.

Figure 7C:
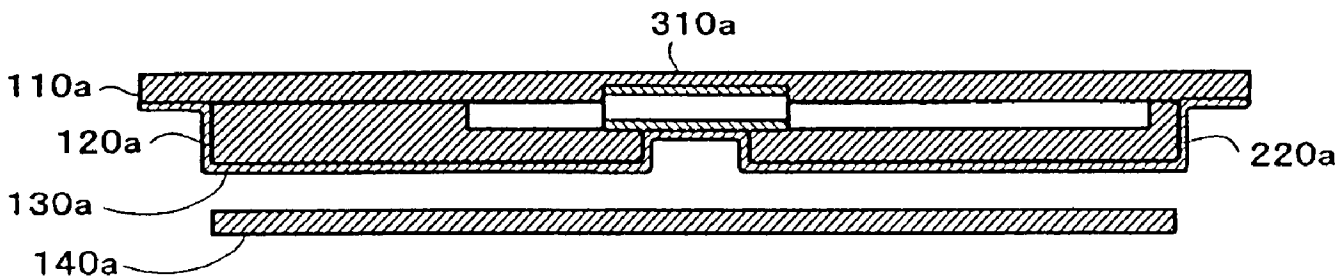

(4) Then, the base plate 140*a* is attached to complete the heat transport device 20 (see FIG. 7C). The base plate 140*a* may be attached during the bonding of the base plates 110*a*, 120*a*, 220*a*, and 130*a*.

Third Embodiment

Figure 8:
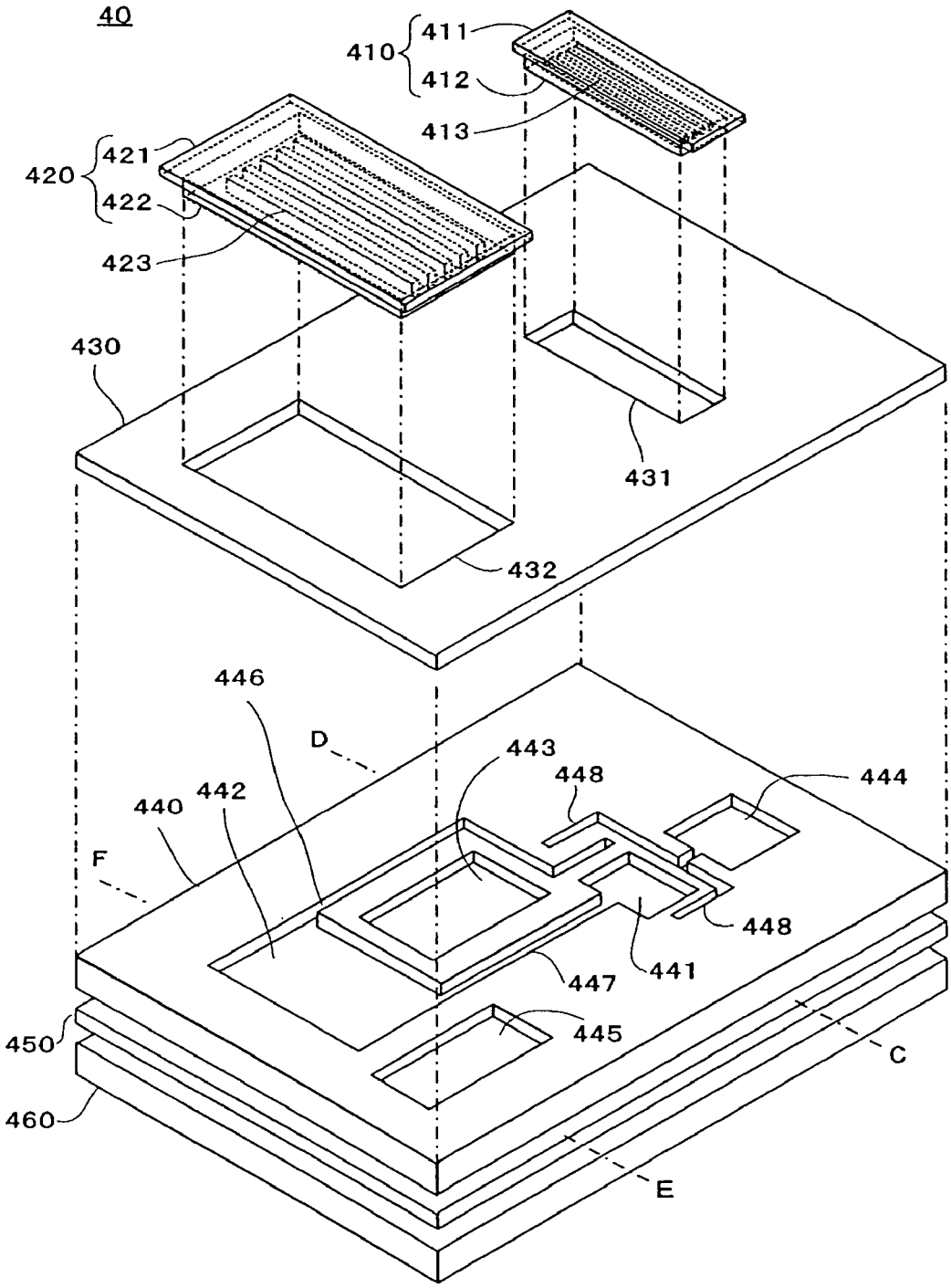
FIG. 8 is an exploded perspective view of a heat transport device according to a third embodiment of the present invention.
Figure 9A:
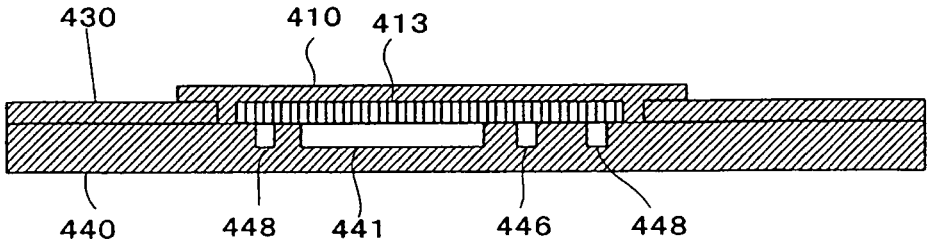
FIGS. 9A and 9B are cross-sectional views of the heat transport device according to the third embodiment of the present invention.
Figure 9B:
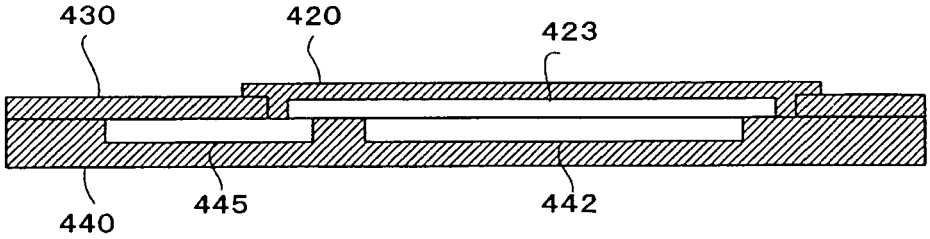
Figure 10:
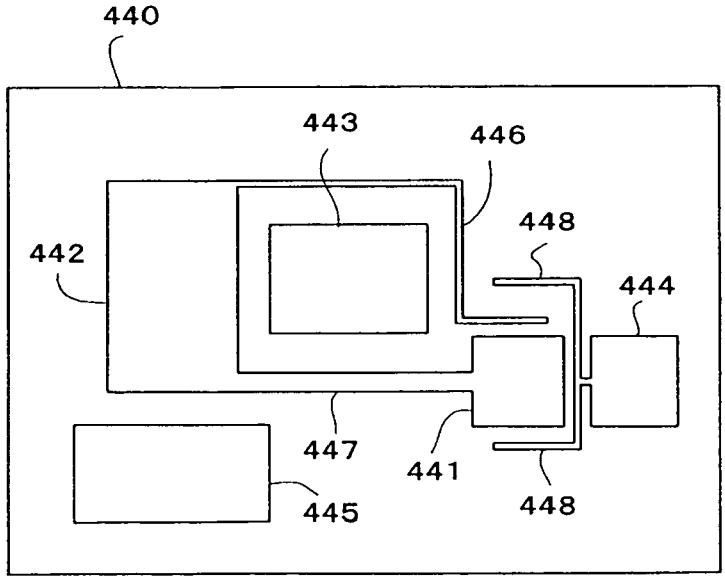
FIG. 10 is a top view of a base plate 440 for the heat transport device according to the third embodiment of the present invention.

FIG. 8 is an exploded perspective view of a heat transport device 40 according to a third embodiment of the present invention. FIGS. 9A and 9B are cross-sectional views when the heat transport device 40 is assembled. These views are taken along lines C-D and E-F, respectively, in FIG. 8. FIG. 10 is a top view of a base plate 440 for the heat transport device 40.

With reference to FIGS. 8 to 10, the heat transport device 40 includes six base plates 410, 420, 430, 440, 450, and 460. The base plates 410 and 420 are fitted into openings 431 and 432, respectively, of the base plate 430 so as not to have any gap. The base plates 410, 420, 430, 440, 450, and 460 are bonded by an adhesive to seal a working fluid (refrigerant).

The base plate 410 includes a flange 411 and a body 412. The body 412 includes grooves 413 on the bottom face.

The flange 411 facilitates the fitting of the base plate 410 to the base plate 430. The flange 411 may not be provided in some cases.

The bottom face of the body 412, together with the base plate 440, functions as a vaporization chamber where the working fluid changes its phase from a liquid (liquid-phase working fluid) to a gas (gas-phase working fluid).

The grooves 413 function as a liquid suction and retention unit (so-called wick) for sucking and retaining the liquid-phase working fluid.

The base plate 420 includes a flange 421 and a body 422. The body 422 has protrusions 423 on the bottom face.

The flange 421 facilitates the fitting of the base plate 420 to the base plate 430. The flange 421 may not be provided in some cases.

The bottom face of the body 422, together with the base plate 440, functions as a liquefaction chamber where the working fluid changes its phase from a gas (gas-phase working fluid) to a liquid (liquid-phase working fluid).

The protrusions 423 function as fins of a condenser for liquefying the gas-phase working fluid to the liquid-phase working fluid.

The base plate 440 includes concavities 441 to 445 and ditches 446 to 448.

The concavity 441, together with the bottom faces of the base plates 410 and 430, functions as a vaporization chamber for vaporizing the liquid-phase working fluid sucked and retained by the grooves 413.

The concavity 442, together with the bottom face of the base plate 420, holds the protrusions 423 and functions as a liquefaction chamber for liquefying the gas-phase working fluid to the liquid-phase working fluid.

The concavity 443 and the bottom face of the base plate 420 define a space for thermal insulation to restrict the thermal conduction through the base plate 440 and to prevent a decrease in cooling efficiency of the heat transport device 40.

The concavity 444, together with the bottom face of the base plate 430, functions as a reservoir for storing a liquid-phase working fluid that is supplied to the grooves 413 when the liquid-phase working fluid retained in the grooves 413 decreases lower than a predetermined level. The supply is performed by sucking the liquid-phase working fluid from the ditch 448 connected to the concavity 444 by capillary force of the grooves 413.

The concavity 445, together with the bottom face 430, functions as a reservoir for storing a liquid-phase working fluid that is supplied to the concavity 442 (liquefaction chamber) when the liquid-phase working fluid retained in the concavity 442 decreases lower than a predetermined level. Since the protrusions 423 (condenser fins) partly face the reservoir, the liquid-phase working fluid is carried from the reservoir to the concavity 442 by the protrusions 423.

The ditch 446, together with the bottom face of the base plate 430, functions as a channel for transporting the liquid-phase working fluid liquefied at the concavity 442 (liquefaction chamber) to the grooves 413 (liquid suction and retention unit).

The ditch 447, together with the bottom face of the base plate 430, functions as a channel for transporting the gas-phase working fluid vaporized at the concavity 441 (vaporization chamber) to the concavity 442 (liquefaction chamber).

Preferably, the base plates 410 and 420 are made of a material having a relatively high thermal conductivity, and the base plates 430 and 440 are made of a material having a relatively high thermal insulation.

The base plates 410 and 420 can be made of a metal, for example, copper, aluminum, or stainless steel (e.g. SUS304). Among them, copper is the most preferable material due to its high thermal conductivity. The base plates 410 and 420 must have a thickness required for forming the flanges 411 and 421, the grooves 413, and the protrusions 423. A sheet having a thickness between 0.05 and 1 mm, for example, 0.3 mm, can be used for the base plates 410 and 420. The flanges 411 and 421 can be integrated with or separated from the bodies 412 and 422, respectively.

The base plates 430 and 440 can be made of plastic (e.g. non-thermoplastic or thermoplastic polyimide material or olefin material), or glass. The base plate 440 must have a thickness required for forming the concavities 441 to 445 and the ditches 446 to 448. A sheet having a thickness between 0.1 to 1 mm, for example, 0.5 mm, can be used for the base plates 430 and 440.

The base plate 450 can be made of a metal, for example, copper, aluminum, or stainless steel (e.g. SUS304). The base plate 450 prevents the efflux of the gas-phase working fluid from the base plate 410 when the base plate 430 is made of plastic. Therefore, the base plate 450 is unnecessary when the base plate 430 is made of glass. A sheet having a thickness of about 0.05 mm, which is sufficient in order to merely prevent the migration of gas, can be used for the base plate 450.

The base plate 460 is provided for reinforcement and can be made of any material. A material that is light in weight and has a certain strength is preferable for reducing the weight of the heat transport device 40. For example, a plastic material such as polyimide is preferable. A sheet having a thickness of, for example, about 0.5 mm can be used for the base plate 460.

(Manufacturing Process of the Heat Transport Device 40)

The base plates 410, 420, 430, 440, 450, and 460 are prepared and then stacked with a bonding material disposed between the respective base plates. The resulting composite is heated under a pressurized condition to complete the heat transport device 40. Since the manufacturing process is substantially the same as that in the first embodiment except that the base plates 410 and 420 are fitted into the base plate 430 during the process, the detailed description is omitted.

As described above, according to the present invention, a heat transport device having a composite structure that is readily manufactured and a method for manufacturing such a heat transport device can be provided.

The invention claimed is:

1. A heat transport device comprising:

a first base plate including a liquid suction and retention unit which retains a liquid-phase working fluid by capillary force;

a body with protrusions on a bottom face thereof;

a second base plate facing the first base plate, the second base plate including a face provided with a first concavity so as to define a vaporization chamber which vaporizes the liquid-phase working fluid retained in the liquid suction and retention unit to a gas-phase working fluid;

a second concavity provided on the face of the second base plate cooperating with the body so as to define a liquefaction chamber which liquefies the gas-phase working fluid vaporized at the vaporization chamber to the liquid-phase working fluid;

a first ditch provided on the face of the second base plate that defines a channel which transports the gas-phase working fluid from the vaporization chamber to the liquefaction chamber, a first end of the first ditch being in fluid communication within the second base plate with the vaporization chamber and a second end of the first ditch being in fluid communication within the second base plate with the liquefaction chamber;

a second ditch provided on the face of the second base plate that defines a further channel which transports the liquid-phase working fluid from the liquefaction chamber to the liquid suction and retention unit, a first end of the second ditch being in fluid communication within the second base plate with the liquefaction chamber and a second end of the second ditch being a closed end adjacent to the vaporization chamber such that the second end of the second ditch is not in fluid communication within the second base plate with the vaporization chamber;

a third concavity provided on the face of the second base plate and disposed between the first ditch and the second ditch, the third concavity cooperating with the first base plate to define a space for thermal insulation; and a thermoplastic or thermosetting resin material bonding the first and second base plates, wherein a surface of the first base plate is covered with a protective film, and wherein the protective film includes silicon or titanium.

2. The heat transport device according to claim 1, further comprising a fourth concavity provided on the face of the second base plate which stores the liquid-phase working fluid that is supplied to the liquid suction and retention unit.

3. The heat transport device according to claim 2, further comprising a fifth concavity provided on the face of the second base plate which stores the liquid-phase working fluid that is supplied to the liquefaction chamber when the liquid-phase working fluid retained in the second concavity decreases lower than a predetermined level.

4. The heat transport device according to claim 1, wherein the first base plate is disposed above the second base plate.

5. The heat transport device according to claim 1, wherein the first base plate includes first and second openings, the liquid suction and retention unit is provided in the first opening and the body is provided in the second opening.

6. A method for manufacturing a heat transport device, comprising:

forming a first base plate including a liquid suction and retention unit configured to retain a liquid-phase working fluid by capillary force, and a body provided with protrusions on a bottom face thereof;

forming a second base plate including a face provided with a first concavity so as to define a vaporization chamber configured to vaporize the liquid-phase working fluid retained in the liquid suction and retention unit to a gas-phase working fluid, a second concavity cooperating with the body so as to define a liquefaction chamber configured to liquefy the gas-phase working fluid vaporized at the vaporization chamber to the liquid-phase working fluid, a first ditch that defines a channel configured to transport the gas-phase working fluid from the vaporization chamber to the liquefaction chamber, a first end of the first ditch being in fluid communication within the second base plate with the vaporization chamber and a second end of the first ditch being in fluid communication within the second base plate with the liquefaction chamber, a second ditch that defines a further channel configured to transport the liquid-phase working fluid from the liquefaction chamber to the liquid suction and retention unit, a first end of the second ditch being in fluid communication within the second base plate with the liquefaction chamber and a second end of the second ditch being a closed end adjacent to the vaporization chamber such that the second end of the second ditch is not in fluid communication within the second base plate with the vaporization chamber, and a third concavity provided on the face of the second base plate and disposed between the first ditch and the second ditch, the third concavity cooperating with the first base plate to define a space for thermal insulation;

laminating the first base plate, a thermoplastic or thermosetting resin material, and the second base plate; and bonding the first and the second base plates with the thermoplastic or thermosetting resin material by heating the composite of the first base plate, the thermoplastic or thermosetting resin material, and the second base plate under a pressurized condition;

oxidizing a surface of the first base plate;

coating the oxidized surface with a thin film of silicon or titanium; and oxidizing the coated surface by plasma treatment.

* * * * *